US009803396B2

(12) United States Patent
Timothy

(10) Patent No.: US 9,803,396 B2
(45) Date of Patent: Oct. 31, 2017

(54) DUAL ACTION GRAVITY LATCH

(71) Applicant: E. Erik Timothy, Apollo Beach, FL (US)

(72) Inventor: E. Erik Timothy, Apollo Beach, FL (US)

(73) Assignee: NATIONWIDE INDUSTRIES, INC., Tampa, FL (US)

( * ) Notice: Subject to any disclaimer, the term of this patent is extended or adjusted under 35 U.S.C. 154(b) by 17 days.

(21) Appl. No.: 14/757,118

(22) Filed: Nov. 20, 2015

(65) Prior Publication Data

US 2017/0145715 A1 May 25, 2017

(51) Int. Cl.
*E05C 19/10* (2006.01)
*E05B 65/00* (2006.01)
*E05C 3/06* (2006.01)

(52) U.S. Cl.
CPC ..... *E05B 65/0007* (2013.01); *E05C 3/06* (2013.01)

(58) Field of Classification Search
CPC ..... Y10T 292/0937; Y10T 292/0943; Y10T 292/0938; Y10T 292/0947; Y10T 292/1063; Y10T 292/1064; Y10T 292/1068; Y10T 292/1071; Y10T 292/1077; Y10T 70/5199; Y10T 70/5345; Y10T 70/5363; Y10T 70/5522; Y10T 70/5527; Y10T 292/0933; Y10T 292/1053; Y10T 292/106; Y10T 70/5204; Y10T 70/5469; Y10T 70/5473; Y10S 292/29; Y10S 292/37; Y10S 70/73; Y10S 292/65; E05B 65/0007; E05C 3/06; E05C 3/08; E05C 3/10
See application file for complete search history.

(56) References Cited

U.S. PATENT DOCUMENTS 2,767,007 A * 10/1956 Burke ..... E05B 65/0046 292/216
3,040,555 A * 6/1962 Wartian ..... E05B 65/0811 292/106
3,677,591 A * 7/1972 Waldo ..... E05B 65/0035 292/221
4,073,520 A * 2/1978 Tsuchiya ..... E05B 83/16 292/216
4,083,591 A * 4/1978 Parisien ..... E05B 65/06 292/202
5,114,195 A * 5/1992 Martin ..... E05C 19/16 292/251.5

(Continued)

*Primary Examiner* — Alyson M Merlino

(57) ABSTRACT

A dual action gravity latch device to secure a gate in a closed position comprising a latch assembly including a pivotal latch member movable between a latched and unlatched position, a keeper assembly including a striker pin to maintain the pivotal latch member in the latched position, a first and second actuator assembly each movable between a first configuration and a second configuration disposed on opposite sides of the gate to selectively engage the pivotal latch member such that when the second actuator assembly is in the first configuration and the first actuator assembly in the second configuration the pivotal latch member is in the unlatched position to allow the gate to be opened and when the first actuator assembly is in the first configuration and the second actuator assembly is in the second configuration the pivotal latch member is in unlatched position to allow the gate to be opened.

16 Claims, 8 Drawing Sheets

(56) References Cited

U.S. PATENT DOCUMENTS 5,362,116 A * 11/1994 Doyle ..... E05C 19/163 292/144
5,490,698 A * 2/1996 Dezso ..... E05B 45/06 292/138
5,664,769 A * 9/1997 Sadinsky ..... E04H 4/06 256/25
5,823,026 A * 10/1998 Finke ..... E05B 47/0002 292/144
6,058,747 A * 5/2000 Doyle ..... E05B 13/105 292/135
6,155,616 A * 12/2000 Akright ..... E05B 5/00 292/198
6,513,351 B2 * 2/2003 Clark ..... E05B 15/0093 292/127
6,666,435 B2 * 12/2003 Blosfelds ..... E05C 19/16 256/24
7,044,511 B2 * 5/2006 Kliefoth ..... E05C 19/163 292/251.5
7,100,405 B2 * 9/2006 West ..... E05B 19/04 292/13
7,201,030 B2 * 4/2007 Timothy ..... E05B 65/0007 292/127
7,390,035 B2 * 6/2008 Karcz ..... E05B 13/101 292/163
8,376,421 B2 * 2/2013 Simmonds ..... E05B 15/101 292/251.5
8,646,815 B2 * 2/2014 Timothy ..... E05B 1/0038 292/69
2007/0175249 A1 * 8/2007 Karcz ..... E05B 65/0007 70/101
2007/0175250 A1 * 8/2007 Karcz ..... E05B 65/0007 70/101
2010/0032966 A1 * 2/2010 Taglianetti ..... E05B 1/0046 292/217
2010/0123321 A1 * 5/2010 Timothy ..... E05B 1/0038 292/69
2010/0148523 A1 * 6/2010 Tai ..... E05B 17/2038 292/236
2010/0244463 A1 * 9/2010 Timothy ..... E05B 13/108 292/113

* cited by examiner

DUAL ACTION GRAVITY LATCH

BACKGROUND OF THE INVENTION

Field of the Invention

A dual action gravity latch device for use with a gate operable from either side of the gate to release the latch permitting the gate to be opened.

Description of the Prior Art

Numerous gate latches have been designed to block or secure openings in fences of other inclosing barriers. Such designs include both gravity operated latches and magnetic latch devices.

U.S. Pat. No. 7,201,030 describes a gate lock device with front and rear units mounted on opposite sides of a structure associated with the gate and against which the gate closes. A gravity latch, displaceably mounted in the housing of the front unit, is engageable with a keeper pin. The front and rear units are provided with key-operated locks which are operable to lock and unlock the gravity latch. The rear unit includes an axially displaceable actuator operable to unlock the gravity latch when the key-operated locks are unlocked.

U.S. Pat. No. 8,646,815 relates to a gate latch system including a button assembly, a latch assembly, and a keeper assembly. The gate latch assembly can be opened from the side of the gate opposite the latch through the use of a spindle extending from a button assembly on one side of the gate to a latch assembly located on the opposite side of the gate and which includes a latch retention member. The latch assembly and button assembly are configured so that the spindle extends from the button assembly to the latch assembly through the gate opening such that there is no need to make a hole through the gate and/or covering to accommodate the spindle.

U.S. Pat. No. 6,058,747 discloses a gravity latch comprising a housing for pivotally mounting a closure member and a cylinder lock located below the closure member. A remote actuator is mounted on the opposite side of the fence from the housing for moving the closure member. The remote actuator may include a lock so that the actuator cannot be operated.

U.S. Pat. No. 6,513,351 discloses a gravity latch which includes a housing for pivotally mounting a closure member and a cylinder lock situated below the closure member. U.S. Pat. No. 6,513,351 also discloses a remote actuator mounted on the opposite side of the fence from which the housing is located. In addition, the remote actuator may include a cylinder lock which is connected through a gearing system to allow for locking the closure member from the remote location.

Examples of gravity operated or similar latch devices or assemblies are found in U.S. Pat. Nos. 2,767,007; 3,040,555; 3,601,799; 3,705,505; 4,073,520; 4,083,591; 2,284,370; US 2007/0175250 and US 2010/0148523.

Further examples of magnetic latch devices can be found in U.S. Pat. Nos. 8,376,421; 5,362,116; 5,664,769; 7,044,511; 7,100,405; 5,114,195; 5,490,698; 5,823,026; 6,155,616; 6,666,435 and 7,390,035.

SUMMARY OF THE INVENTION

The present invention relates to a dual action gravity latch device comprising a latch assembly including a pivotal latch member mounted to a fence and a keeper or striker assembly including a striker pin attached to a gate disposed to selectively engage the pivot latch member.

The dual action gravity latch device further includes a first actuator assembly and a second actuator assembly each movable between a first configuration and a second configuration to engage and move the pivotal latch member from a first position to a second position to allow the gate to be opened.

The latch assembly comprises a latch housing having a keeper receiver opening to receive a portion of the keeper assembly and striker pin. The pivotal latch member comprises a hook-like member, a first or upper latch extension formed on the upper inner portion thereof and a second latch or lower latch extension formed on the lower inner portion thereof to selectively engage the first actuator assembly and the second actuator assembly respectively.

The pivotal latch member is pivotally mounted within the latch housing normally disposed in the latched position due to gravity. A spring or bias may be used as an additional force to normally maintain the pivotal latch member in the latched position.

The first actuator assembly comprises a first actuator subassembly rotatably between a first position and a second position disposed in the upper portion of the latch housing and a second actuator subassembly movable vertically between a first or upper position and a second or lower position disposed between the first actuator subassembly and the first or upper latch extension or element such that the first actuator subassembly engages the upper portion of the second actuator subassembly when the first actuator subassembly is rotated from the first position to the second position moving the second actuator subassembly vertically downward from the upper or first position to the lower or second position to engage the first or upper latch extension and rotate the hook-like member upwardly clearing or unlatching the striker pin from the striker pin recess allowing the gate to be opened. The bias will return the hook-like member to the latched position when the first actuator subassembly is rotated from the second position to the first position.

The second actuator assembly comprises a first actuator subassembly movable horizontally between a first position and a second position and a second actuator subassembly movable between a first position and a second disposed between the first actuator subassembly and the second or lower latch extension such that the second actuator subassembly engages the second or lower latch extension when the first actuator subassembly is moved horizontally from the first position to the second position to rotate the hook-like member upwardly clearing or unlatching the striker pin from the striker pin recess allowing the gate to be opened. The bias will return the hook-like member to the latched position when the first actuator subassembly is released and the bias returns from the second position to the first position as described hereinafter.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
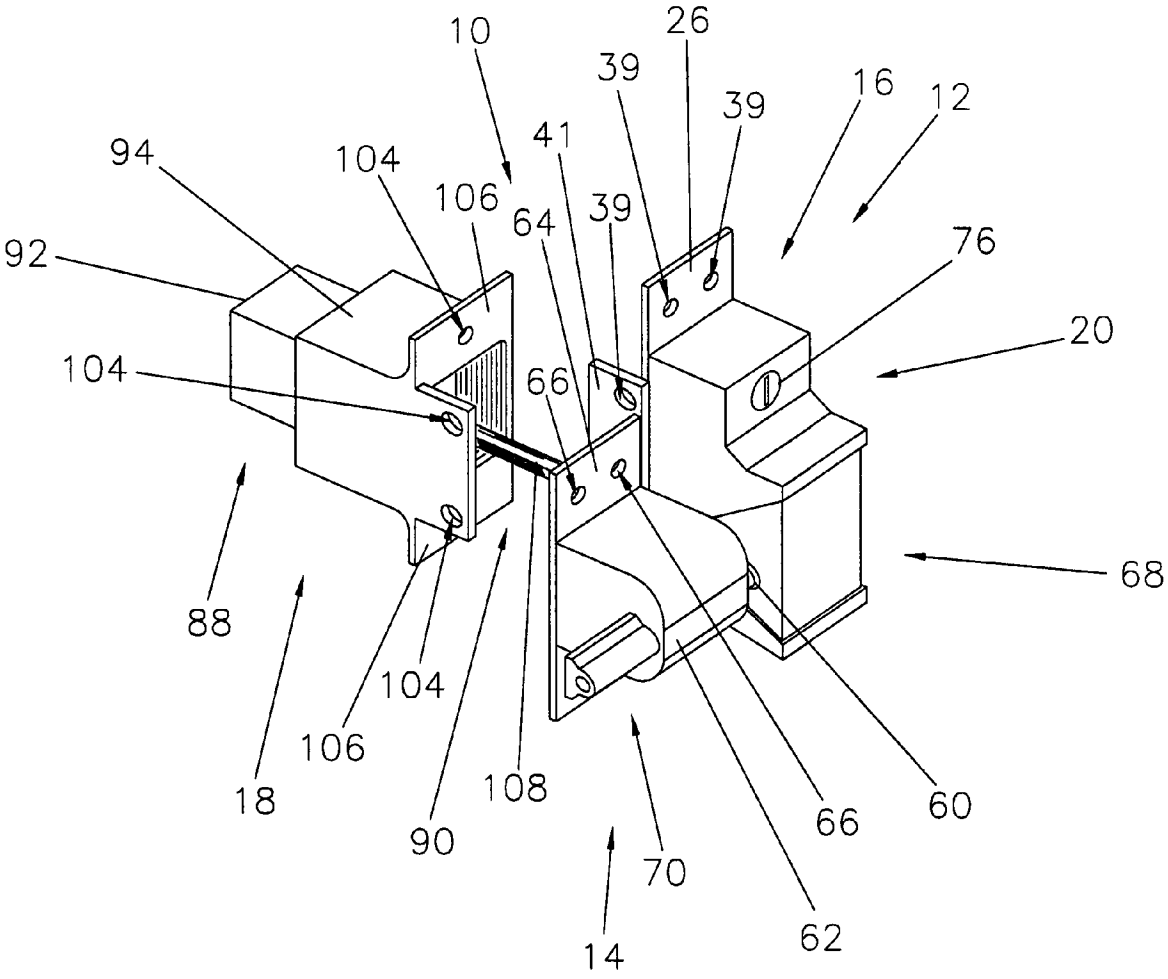
FIG. 1 is a perspective front view of the dual action gravity latch device of the present invention.
Figure 2:
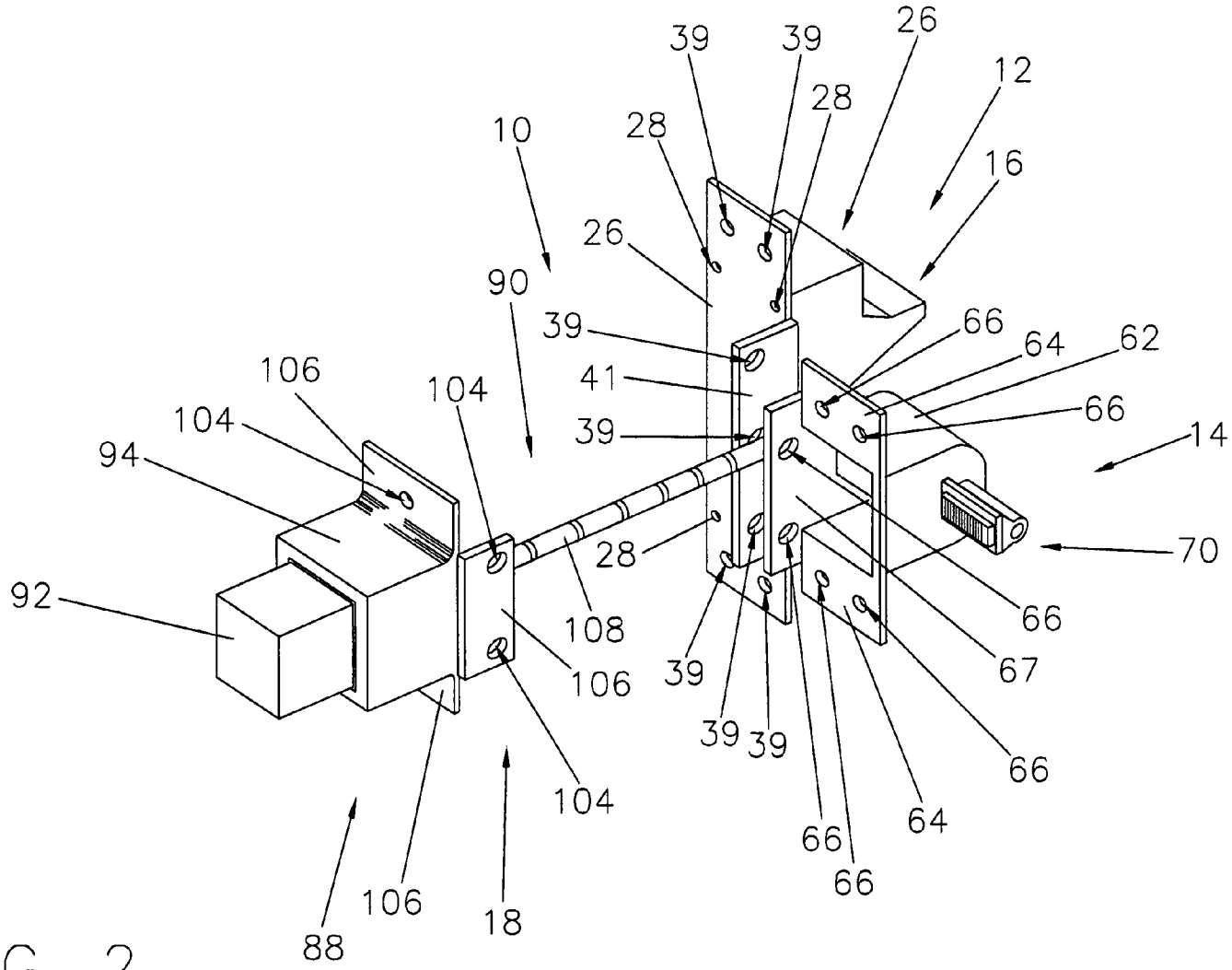
FIG. 2 is a perspective rear view of the dual action gravity latch device of the present invention.
Figure 3:
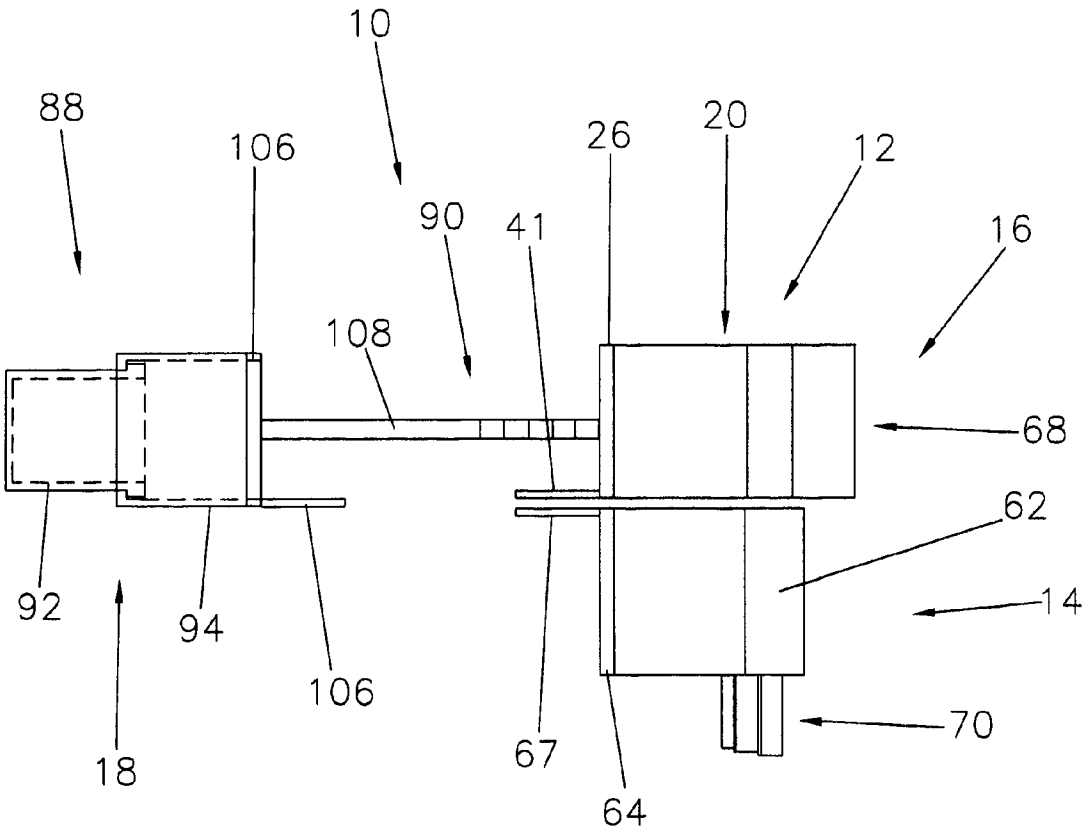
FIG. 3 is a top view of the dual action gravity latch device of the present invention.

The present invention relates to a dual action gravity latch device generally indicated as 10 comprising a latch assembly generally indicated as 12 including a substantially vertical pivotal latch member mounted to a fence (not shown) and a keeper or striker assembly generally indicated as 14 including a substantially horizontal striker pin attached to a gate (not shown) disposed to selectively engage the substantially vertical pivot latch member.

The dual action gravity latch device 10 further includes a first actuator assembly 16 and a second actuator assembly 18 each movable between a first position or configuration and a second position or configuration to engage and move the substantially vertical pivotal latch member from a first position to a second position to allow the gate (not shown) to be opened.

As shown in FIGS. 4 through 7, the latch assembly 12 comprises a latch housing generally indicated as 20 having a keeper receiver opening 22 formed in the front wall 24 to receive a portion of the keeper assembly 14 when the gate (not shown) is closed and a rear plate 26 secured together by fasteners 28 extending through corresponding apertures 30 formed in the rear plate 26 and into corresponding apertures or recesses 32 formed in the latch housing 20 to house the substantially vertical pivotal latch member generally indicated as 34 therein. The substantially vertical pivotal latch member 34 comprises a hook-like member 36 including an outer tip 37 disposed within the keeper receiver opening 22 and a striker pin recess 38 formed in forward or outer portion thereof, a first or upper latch extension or element 40 formed on the upper rear or inner portion thereof and a second latch or lower latch extension or element 42 formed on the lower rear or inner portion thereof to selectively engage the first actuator assembly 16 and the second actuator assembly 18 respectively as described hereinafter.

Figure 5:
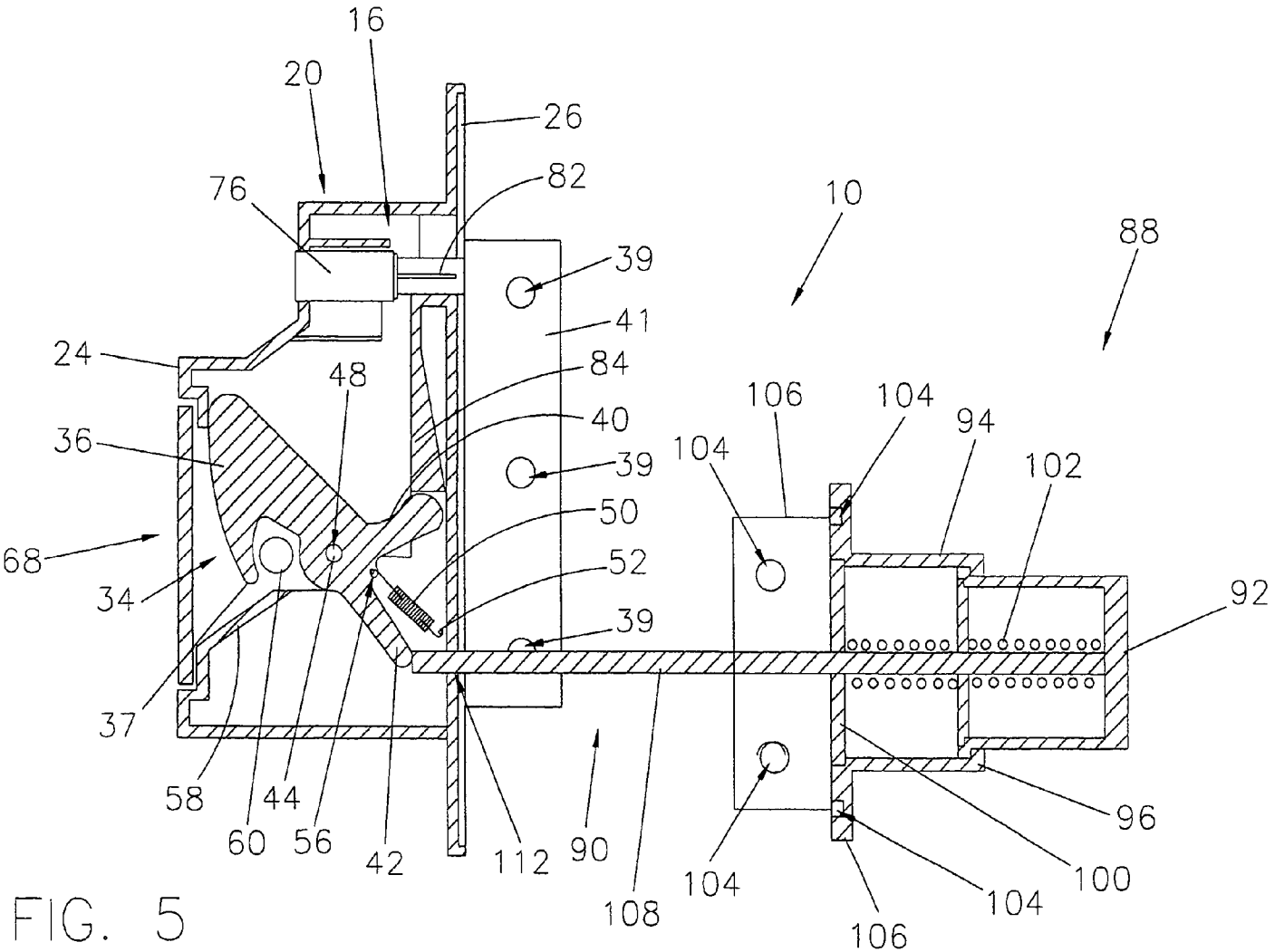
FIG. 5 is a cross-sectional side view of the dual action gravity latch device of the present invention with the first actuator assembly and the second actuator assembly each in the first position or configuration and the latch in the latched position.
Figure 6:
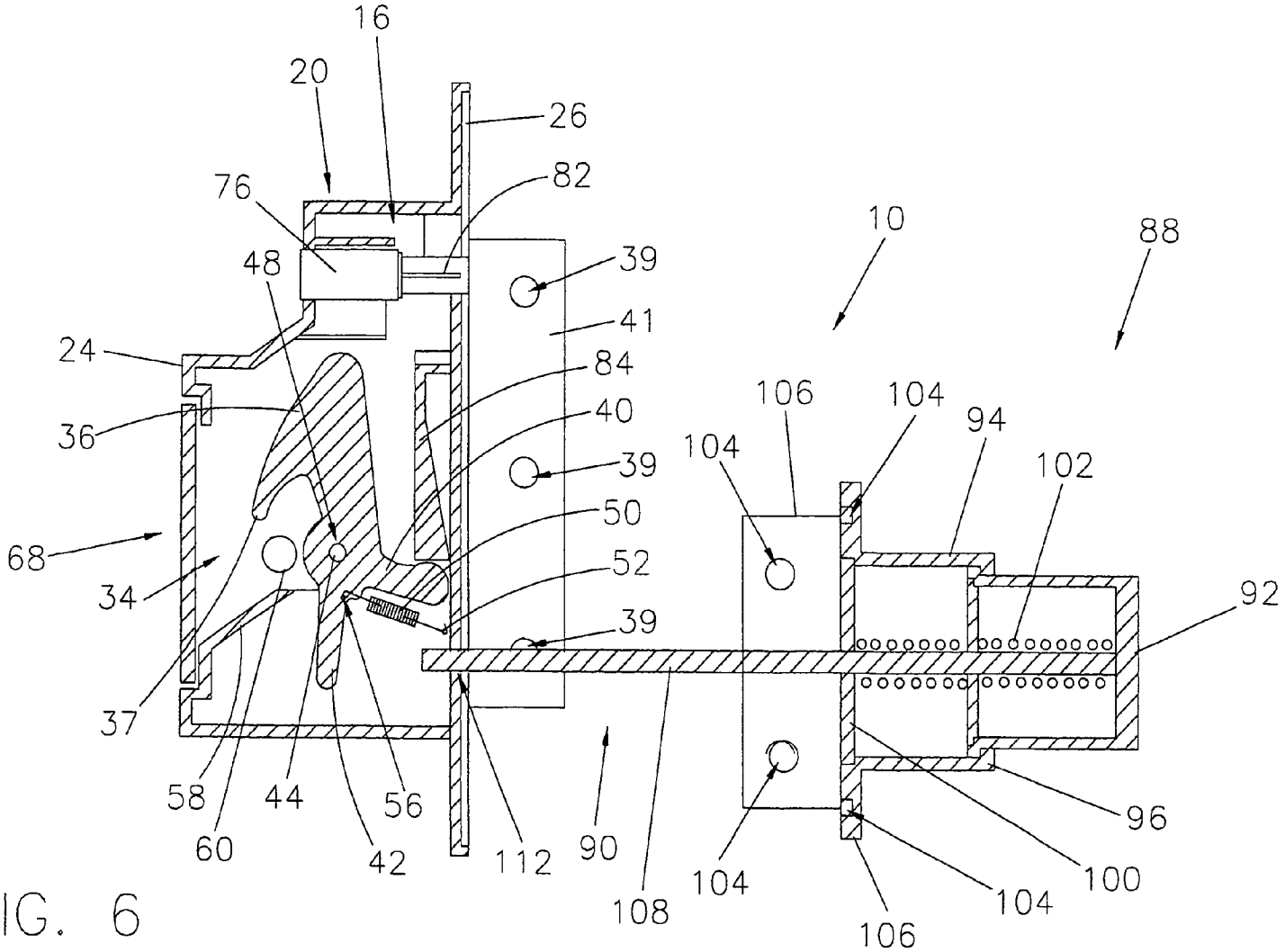
FIG. 6 is a cross-sectional side view of the dual action gravity latch device with the first actuator assembly in the second position or configuration and the latch in the unlatched position.
Figure 7:
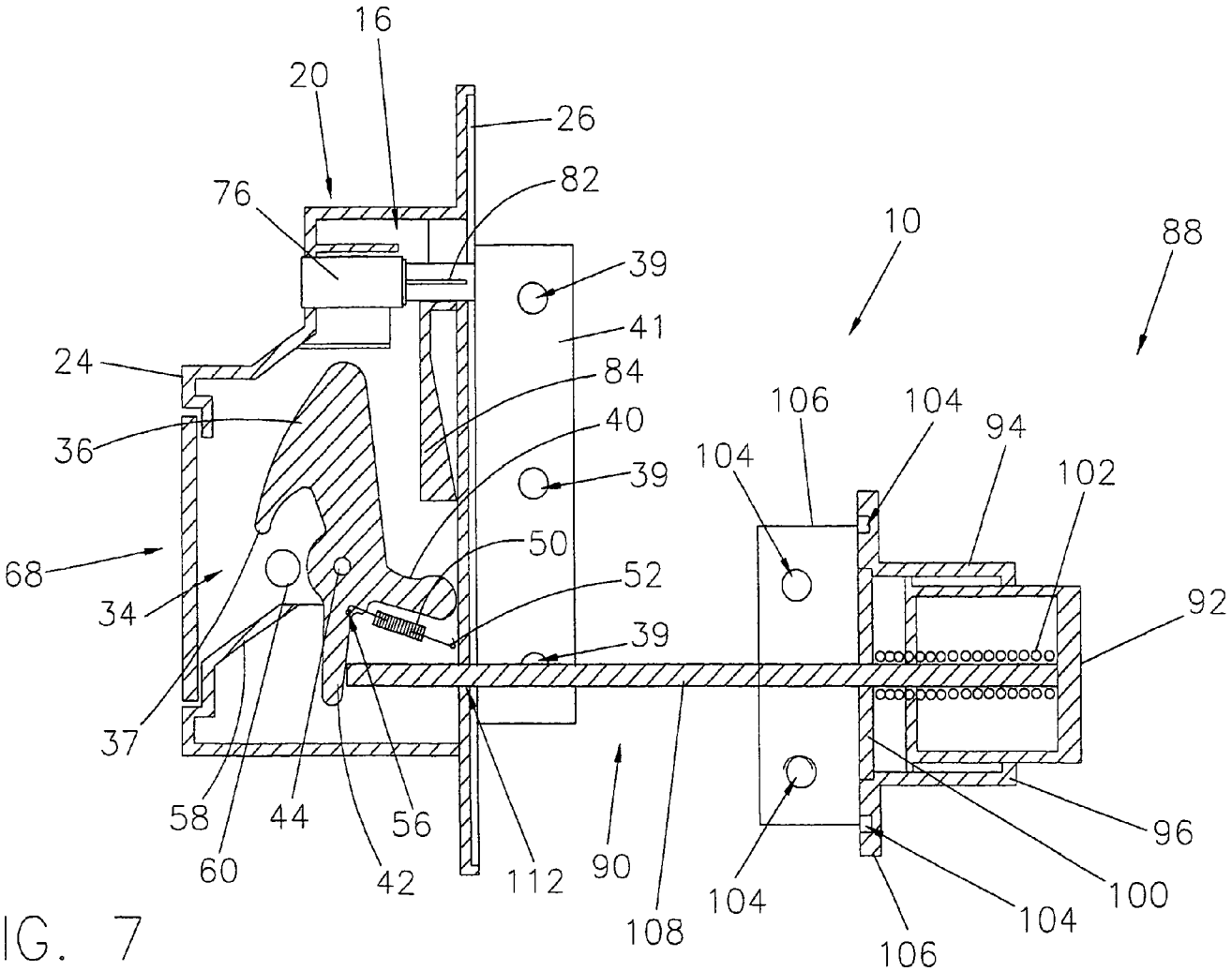
FIG. 7 is a cross-sectional side view of the dual action gravity latch device with the second actuator assembly in the second position or configuration and the latch in the unlatched position.
Figure 8:
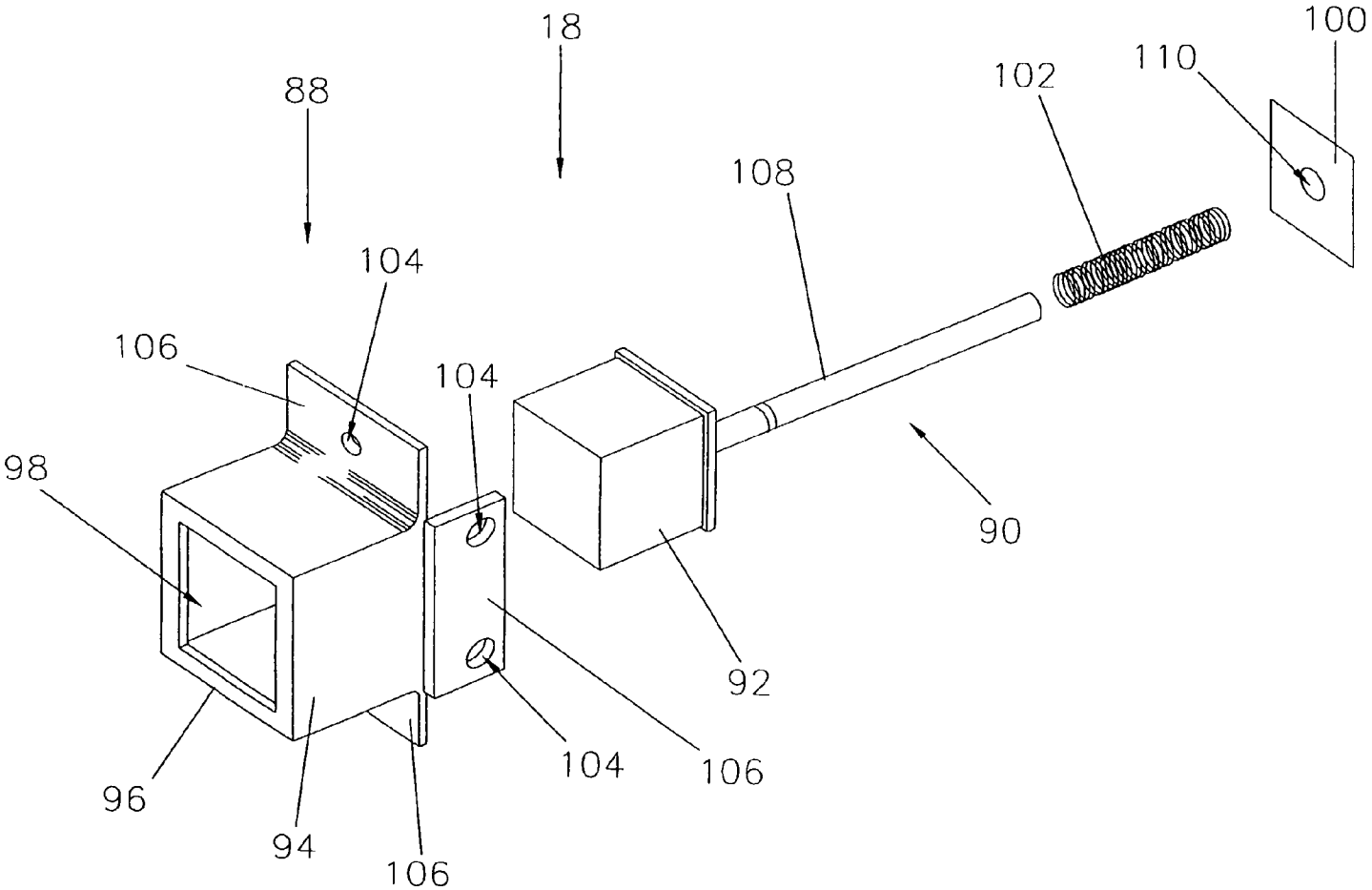
FIG. 8 is an exploded view of the second actuator assembly of the dual action gravity latch device of the present invention.

The substantially vertical pivotal latch member 34 is pivotally mounted within the latch housing 20 on a latch mounting pin 44 extending between opposite sides 46 of the latch housing 20 and through a pivot aperture 48 formed through the rear portion of the substantially vertical pivotal latch member 34. The substantially vertical pivotal latch member 34 is normally disposed in the latched position (FIG. 5) due to gravity. A spring or bias 50 extending between a bias mounting pin 52 extending between opposite sides 46 of the latch housing 20 and a hole 56 formed in the second latch or lower latch extension or element 42 of the substantially vertical pivot latch member 34 may provide an additional force to maintain the substantially vertical pivotal latch member 34 in the latched position. A support member or ledge 58 extends diagonally upward from the lower front portion of the latch housing 20 to engage and support the outer tip 37 of the hook-like member or hook member 36 of the substantially vertical pivotal latch member 34 when in the latched position (FIG. 5).

Figure 4:
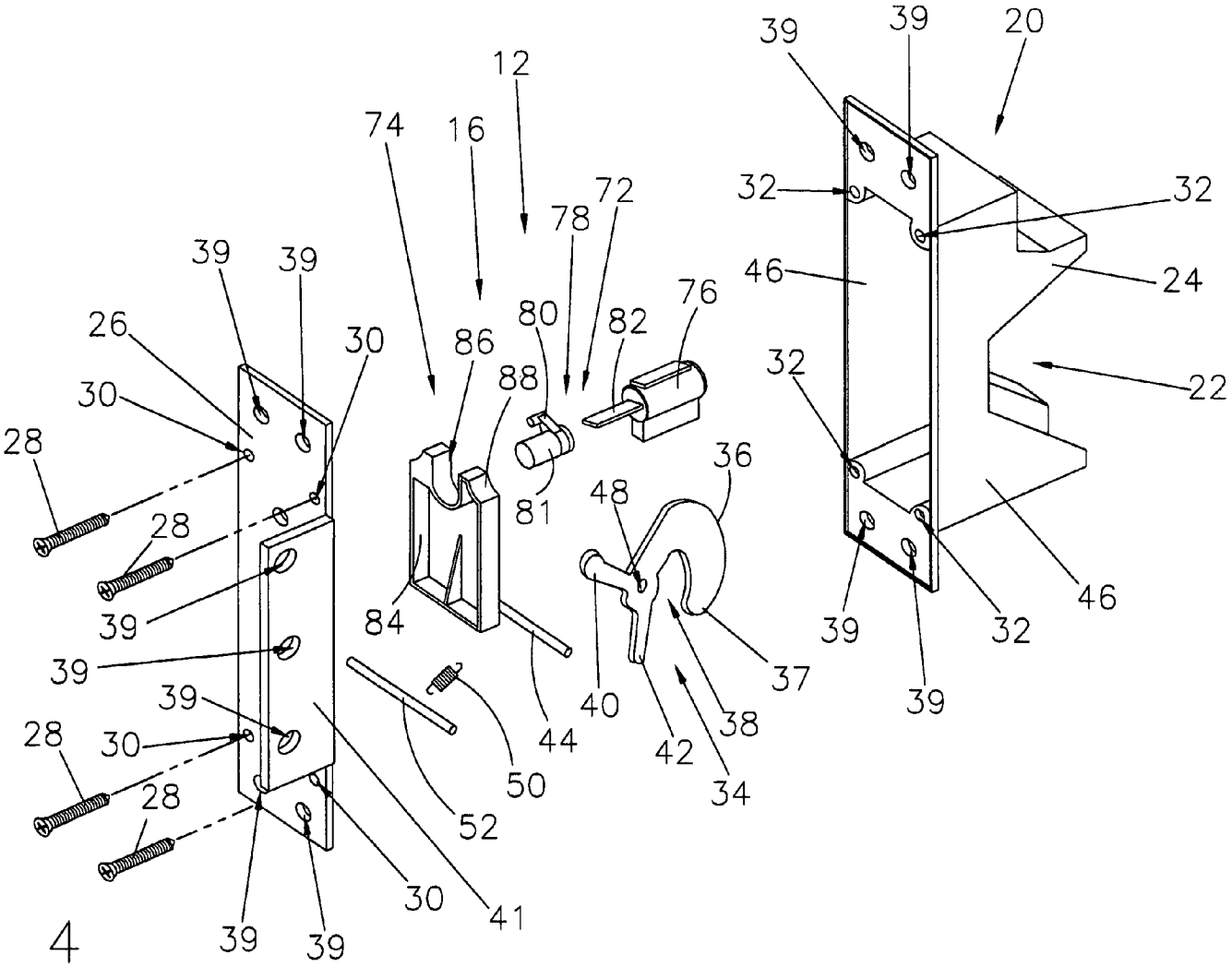
FIG. 4 is an exploded perspective rear view of the first actuator assembly of the dual action gravity latch device of the present invention.

The latch housing 20 and the rear plate 26 are affixed to the fence (not shown) with fasteners (not shown) passing through holes 39 formed in the rear plate 26 and a side mounting flange 41 (FIG. 4).

As shown in FIGS. 1 through 3 and 5 through 7, the keeper or striker assembly 14 comprises a substantially horizontal striker pin 60 extending between a coupling housing 62 affixed to the gate (not shown) by an upper and lower attachment flanges each indicated as 64 including holes 66 and a side attachment flange 67 to receive fasteners such as screws (not shown) and a striker pin shroud generally indicated as 68 disposed within the keeper receiver opening 22 when the gate (not shown) is closed to substantially enclose the substantially vertical pivot latch member 34 and the substantially horizontal striker pin 60 within the latch housing 20 and the striker pin shroud 68.

The distance the substantially horizontal striker pin 60 extends outwardly from the coupling housing 62 or gate (not shown) toward the latch assembly 14 may be adjusted by a striker pin adjustment assembly generally indicated as 70.

As best shown in FIGS. 4 through 7, the first actuator assembly 16 comprises a first actuator subassembly generally indicated as 72 rotatable between a first position and a second position disposed in the upper portion of the latch housing 20 and a second actuator subassembly generally indicated 74 movable substantially vertically between a first or upper position (FIG. 5) and a second or lower position (FIG. 6) disposed between the first actuator subassembly 72 and the first or upper latch extension or element 40 such that the first actuator subassembly 72 engages the upper portion of the second actuator subassembly 74 when the first actuator subassembly 72 is rotated from the first position to the second position moving the second actuator subassembly 74 linearly downward from the upper or first position to the lower or second position to engage the first or upper latch extension or element 40 and rotate the hook-like member 36 upwardly clearing or unlatching the substantially horizontal striker pin 60 from the striker pin recess 38 allowing the gate (not shown) to be opened. Gravity will return the hook-like member 36 to the latched position when the first actuator subassembly 72 is rotated or returned from the second position to the first position.

As best shown in FIG. 4, the first actuator subassembly 72 comprises a cylinder lock 76 mounted to or on the upper portion of the latch housing 20 having an arm or cam member generally indicated as 78 operatively coupled thereto. The arm or cam member 78 comprises a first arm or cam element 80 coupled to the cylinder element 82 and a second arm or cam element 81 coupled to the upper portion of the second actuator subassembly 74. Of course, a simple first rotatable actuator lever may be substituted for the cylinder lock 76.

The second actuator subassembly 74 comprises a substantially vertical block 84 including a substantially vertical centrally disposed slot 86 formed in the upper portion thereof and a recess or shoulder 88 formed to one side of the substantially vertical centrally disposed slot 86 to receive the second arm or cam member 81.

As best shown in FIGS. 5 through 8, the second actuator assembly 18 comprises a first actuator subassembly generally indicated as 88 movable horizontally between a first position and a second position disposed in behind the latch housing 20 and a second actuator subassembly generally indicated as 90 movable between a first or rearward position (FIG. 5) and a second or forward position (FIG. 7) disposed between the first actuator subassembly 88 and the second or lower latch extension or element 42 such that the second actuator subassembly 90 engages the second or lower latch extension or element 42 when the first actuator subassembly 88 is moved linearly from the first position to the second position to rotate the hook-like member 36 upwardly clearing or unlatching the substantially horizontal striker pin 60 from the striker pin recess 38 allowing the gate (not shown) to be opened. Gravity will return the hook-like member 36 to the latched position when the first actuator subassembly 88 is released and the bias 102 returns the first position actuator subassembly 88 and the second actuator assembly housing 94 from the second position to the first position.

As best shown in FIGS. 5 through 8, the first actuator subassembly 88 comprises a plunger 92 partially retained within a second actuator assembly housing 94 by an outer retainer flange 96 disposed around the periphery of an outer plunger opening 98 and an inner retainer plate 100 and a bias or spring 102 disposed within the second actuator assembly housing 94 to normally maintain the first actuator subassembly 88 in the first position. The first actuator subassembly 88 is attached to the fence (not shown) by fasteners (not shown) placed through holes 104 formed in flanges 106.

The second actuator subassembly 90 comprises a substantially horizontal bar or member 108 coupled to the plunger 92 through apertures 110 and 112 formed through the inner retainer plate 100 and the rear plate 26 respectively to engage the second or lower latch extension or element 42 of the substantially vertical pivotal latch member 34.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described:

What is claimed is:

1. A dual action gravity latch device to secure a gate in a closed position to block an opening or portal in a fence, the dual action gravity latch device comprising a latch assembly including a pivotal latch member movable between a latched position and an unlatched position and a bias to maintain said pivotal latch member in said latched position, a keeper assembly, a first actuator assembly and a second actuator assembly, each having a part movable linearly between a first position or configuration and a second position or configuration, and being disposed on opposite sides of the gate to selectively engage said pivotal latch member and selectively move said pivotal latch member from said latched position to said unlatched position, wherein when a part of said first actuator assembly is moved linearly and vertically from said first position or configuration to said second position or configuration, said part of said first actuator assembly moves said pivotal latch member from said latched position to said unlatched position to allow the gate to be opened, and wherein when said part of said second actuator assembly is moved linearly and horizontally from said first position or configuration to said second position or configuration, said part of said second actuator assembly moves said pivotal latch member from said latched position to said unlatched position to allow the gate to be opened.

2. The dual action gravity latch device of claim 1 wherein said pivotal latch member comprises a hook member and a striker pin recess formed in a forward or outer portion thereof, said hook member including a first or upper latch extension or element formed on an upper rear or inner portion thereof, and a second latch or lower latch extension or element formed on a lower rear or inner portion thereof, said first or upper latch extension or element and said second or lower latch extension or element selectively engage said first actuator assembly and said second actuator assembly, respectively, such that said pivotal latch member is selectively moved from said latched position to said unlatched position.

3. The dual action gravity latch device of claim 2 wherein said first actuator assembly comprises a first actuator subassembly having at least a part movable between a first position and a second position and is disposed in the upper portion of said latch assembly and wherein said part of said first actuator assembly is disposed between said first actuator subassembly and said first or upper latch extension or element of said pivot latch member such that said first actuator subassembly linearly and vertically moves said part of said first actuator assembly when said at least a part of said first actuator subassembly is moved from said first position to said second position so as to move said part of said first actuator assembly from said first position or configuration to said second position or configuration such that said part of said first actuator assembly engages said first or upper latch extension or element, rotating said hook member upwardly, allowing the gate to be opened.

4. The dual action gravity latch device of claim 3 wherein said hook member rotates when said pivotal latch member moves from said unlatched position to said latched position when said at least a part of said first actuator subassembly is moved from said second position to said first position.

5. The dual action gravity latch device of claim 3 wherein said first actuator subassembly comprises an actuator mounted to or on the upper portion of said latch assembly and having an arm or cam member operatively coupled thereto, said arm or cam member comprises a first arm or cam element coupled to said actuator and a second arm or cam element coupled to said part of said first actuator assembly, and said part of said first actuator assembly comprises a block including a recess to receive said second arm or cam member.

6. The dual action gravity latch device of claim 2 wherein said second actuator assembly comprises a first actuator subassembly having a part movable linearly and horizontally between a first position and a second position and said part of said second actuator subassembly is disposed between said part of said first actuator subassembly and said second or lower latch extension or element such that said part of said second actuator assembly engages said second or lower latch extension or element when said part of said first actuator subassembly is moved linearly and horizontally from said first position to said second position to rotate said hook member upwardly, allowing the gate to be opened.

7. The dual action gravity latch of claim 6 wherein said part of said first actuator subassembly comprises a plunger including a bias to bias to said plunger to said first position.

8. The dual action gravity latch of claim 7 wherein said hook member rotates when said pivotal latch member moves from said unlatched position to said latched position.

9. The dual action gravity latch device of claim 2 wherein said first actuator assembly comprises a first actuator subassembly having at least a part movable between a first position and a second position and is disposed in an upper portion of said latch assembly, and said part of said first actuator assembly is disposed between said first actuator subassembly and said first or upper latch extension or element of said pivotal latch member such that said first actuator subassembly linearly and horizontally moves said part of said first actuator assembly when said at least a part of said first actuator subassembly is moved from said first position to said second position so as to move said part of said first actuator assembly from said first position or configuration to said second position or configuration such that said part of said first actuator assembly engages said first latch or upper extension or element, rotating said hook member upwardly and allowing the gate to be opened, and wherein said second actuator assembly comprises a first actuator subassembly including a part movable between a first position and a second position, and said part of said second actuator assembly is disposed between said first actuator subassembly and said second or lower latch extension or element such that said part of said second actuator assembly engages said second or lower latch extension or element when said part of said first actuator subassembly is moved from said first position to said second position, so as to linearly and vertically move said part of said second actuator assembly causing said hook upwardly and allowing the gate to be opened.

10. The dual action gravity latch device of claim 9 wherein said first actuator subassembly of said first actuator assembly comprises a cylinder mounted to or on the upper portion of said latch assembly and having an arm or cam member operatively coupled thereto, said arm or cam member comprises a first arm or cam element coupled to said cylinder and a second arm or cam element coupled to said second actuator subassembly of said first actuator assembly, and said part of said first actuator assembly comprises a block including a recess to receive said second arm or cam member and wherein said part of said first actuator subassembly of said second actuator assembly comprises a plunger including a bias to bias said plunger in said first position.

11. The dual action gravity latch device of claim 2 wherein said first actuator assembly comprises a first actuator subassembly having at least a part rotatable between a first position and a second position and is disposed in an upper portion of the said latch assembly, and said part of said first actuator assembly is disposed between said first actuator subassembly and said first or upper latch extension or element of said pivotal latch member such that said first actuator subassembly linearly and vertically moves said part of said first actuator assembly from said first position or configuration to said second portion or configuration when said at least a part of said first actuator subassembly is rotated from said first position to said second position, such that said part of said first actuator assembly engages said first or upper latch extension or element' rotating said hook member upwardly and allowing the gate to be opened.

12. The dual action gravity latch device of claim 2 wherein said second actuator assembly comprises a first actuator subassembly having a part movable linearly and horizontally between a first position and a second position, and said part of said second actuator assembly is disposed between said first actuator subassembly and said second or lower latch extension or element of said pivotal latch member such that said part of said second actuator assembly engages said second or lower latch extension or element when said part of said first actuator subassembly is moved linearly and horizontally from said first position to said second position so as to rotate said hook member upwardly and allowing the gate to be opened.

13. A dual action gravity latch device to secure a gate in a closed position to block an opening or portal in a fence, the dual action gravity latch device comprising a latch assembly including a pivotal latch member movable between a latched position and an unlatched position and a bias to maintain said pivotal latch member in said latched position, a keeper assembly, and a first actuator assembly and a second actuator assembly, each having a part movable linearly between a first position or configuration and a second position or configuration, and being disposed on opposite sides of the gate to selectively engage said pivotal latch member and selectively move said pivotal latch member from said latched position to said unlatched position, wherein when said part of said second actuator assembly is in said first position or configuration and said part of said first actuator assembly is moved linearly and vertically from said first position or configuration to said second position or configuration, said part of said first actuator assembly moves said pivotal latch member from said latched position to said unlatched position to allow the gate to be opened' and when said part of said first actuator assembly is in said first position or configuration and said part of said second actuator assembly is moved linearly and, horizontally from said first position or configuration to said second position or configuration' said part of said second actuator assembly moves said pivotal latch member from said latched position to said unlatched position to allow the gate to be opened.

14. A dual action gravity latch device to secure a gate in a closed position to block an opening or portal in a fence, the dual action gravity latch device comprising a latch assembly including a pivotal latch member movable between a latched position and an unlatched position and a bias to maintain said pivotal latch member in said latched position, a keeper assembly, a first actuator assembly' and a second actuator assembly, said first actuator assembly having a part movable linearly between a first position or configuration and a second position or configuration and said second actuator assembly having at least a part movable linearly between a first position or configuration and a second position or configuration, and said first actuator assembly and said second actuator assembly being disposed on opposite sides of the gate to selectively engage said pivotal latch member and selectively move said pivotal latch member from said latched position to said unlatched position, wherein when said part of said first actuator assembly is moved linearly and vertically from said first position or configuration to said second position or configuration, said part of said first actuator assembly moves said pivotal latch member from said latched position to said unlatched position to allow the gate to be opened, and wherein when said at least a part of said second actuator assembly is moved linearly and horizontally from said first position or configuration to said second position or configuration, said at least a part of said second actuator assembly moves said pivotal latch member from said latched position to said unlatched position to allow the gate to be opened, wherein said pivotal latch member comprises a hook member and a striker pin recess formed in forward or outer portion thereof, said hook member including a first or upper latch extension or element formed on an upper rear or inner portion thereof, and a second latch or lower latch extension or element formed on a lower rear or inner portion thereof, said first or upper latch extension or element and said second or lower latch extension or element selectively engage said first actuator assembly and said second actuator assembly, respectively, such that said pivotal latch member is selectively moved from said latched position to said unlatched position' wherein said first actuator assembly comprises a first actuator subassembly having at least a part movable between a first position and a second position and is disposed in an upper portion of said latch assembly and said part of said first actuator assembly is disposed between said first actuator subassembly and said first or upper latch extension or element of said pivot latch member such that said first actuator subassembly linearly and vertically moves said part of said first assembly when said at least a part of said first actuator subassembly is moved from said first position to said second position so as to move said part of said actuator first assembly from said first position or configuration to said second position or configuration such that said part of said first actuator assembly engages said first or upper latch extension or element, rotating said hook member upwardly, allowing the gate to be opened' and wherein said first actuator subassembly comprises an actuator mounted to or on the upper portion of said latch assembly and having an arm or cam member operatively coupled thereto, said arm or cam member comprises a first arm or cam element coupled to said actuator and a second arm or cam element coupled to said part of said first actuator assembly, and said part of said first actuator assembly comprises a block including a recess to receive said second arm or cam member.

15. A dual action gravity latch device to secure a gate in a closed position to block an opening or portal in a fence, the dual action gravity latch device comprising a latch assembly including a pivotal latch member movable between a latched position and an unlatched position and a bias to maintain said pivotal latch member in said latched position, a keeper assembly, and, a first actuator assembly and a second actuator assembly, each having a part movable linearly between a first position or configuration and a second position or configuration, and being disposed on opposite sides of the gate to selectively engage said pivotal latch member and selectively move said pivotal latch member from said latched position to said unlatched position, wherein when said part of said first actuator assembly is moved linearly and vertically from said first position or configuration to said second position or configuration, said part of said first actuator assembly moves said pivotal latch member from said latched position to said unlatched position to allow the gate to be opened, and wherein when said part of said second actuator assembly is moved linearly and horizontally from said first position or configuration to said second position or configuration, said part of said second actuator assembly moves said pivotal latch member from said latched position to said unlatched position to allow the gate to be opened, wherein said pivotal latch member comprises a hook member and a striker pin recess formed in forward or outer portion thereof, said hook member including a first or upper latch extension or element formed on an upper rear or inner portion thereof, and a second latch or lower latch extension or element formed on a lower rear or inner portion thereof, said first or upper latch extension or element and said second or lower latch extension or element selectively engage said first actuator assembly and said second actuator assembly, respectively, such that said pivotal latch member is selectively moved from said latched position to said unlatched position, wherein said first actuator assembly comprises a first actuator subassembly having at least a part movable between a first position and a second position and is disposed in an upper portion of said latch assembly, and said part of said first actuator assembly is disposed between said first actuator subassembly and said first or upper latch extension or element of said pivotal latch member such that said first actuator subassembly linearly and vertically moves said part of said first actuator assembly when said at least a part of said first actuator subassembly is moved from said first position to said second position so as to move said part of said first actuator assembly from said first position or configuration to said second position or configuration such that said part of said first actuator assembly engages said first latch or upper extension or element, rotating said hook member upwardly, and allowing the gate to be opened, and wherein said second actuator assembly comprises a first actuator subassembly including a part movable between a first position and a second position, and said part of said second actuator assembly is disposed between said first actuator subassembly of said second actuator and said second or lower latch extension or element such that said part of said second actuator assembly engages said second or lower latch extension or element when said part of said first actuator subassembly is moved from said first position to said second position, so as to linearly and horizontally move said part of said second actuator assembly causing said hook member to rotate upwardly, and allowing the gate to be opened' and wherein said first actuator subassembly of said first actuator assembly comprises cylinder mounted to or on the upper portion of said latch assembly and having an arm or cam member operatively coupled thereto, said arm or cam member comprises a first arm or cam element coupled to said cylinder and a second arm or cam element coupled to said part of said first actuator assembly, and said part of said first actuator assembly comprises a block including a recess to receive said second arm or cam member, and wherein said part of said first actuator subassembly of said second actuator assembly comprises a plunger including a bias to bias said plunger in said first position.

16. A dual action gravity latch device to secure a gate in a closed position to block an opening or portal in a fence, the dual action gravity latch device comprising a latch assembly including a pivotal latch member movable between a latched position and an unlatched position and a bias to maintain said pivotal latch member in said latched position, a keeper assembly, a first actuator assembly' and a second actuator assembly, said first actuator assembly having a part movable linearly between a first position or configuration and a second position or configuration and said second actuator assembly having at least a part movable linearly between a first position or configuration and a second position or configuration, and said first actuator assembly and said second actuator assembly being disposed on opposite sides of the gate to selectively engage said pivotal latch member and to selective move said pivotal latch member from said latched position to said unlatched position, wherein when said part of said first actuator assembly is moved linearly and vertically from said first position or configuration to said second position or configuration, said part of said first actuator assembly moves said pivotal latch member from said latched position to said unlatched position to allow the gate to be opened, and wherein when said at least a part of said second actuator assembly is moved linearly and horizontally from said first position or configuration to said second position or configuration, said at least a part of said second actuator assembly moves said pivotal latch member from said latched position to said unlatched position to allow the gate to be opened, wherein said pivotal latch member comprises a hook member and a striker pin recess formed in a forward or outer portion thereof, said hook member including a first or upper latch extension or element formed on an upper rear or inner portion thereof, and a second latch or lower latch extension or element formed on a lower rear or inner portion thereof, said first or upper latch extension or element and said second or lower latch extension or element selectively engage said first actuator assembly and said second actuator assembly, respectively, such that said pivotal latch member is selectively moved from said latched position to said unlatched position' and wherein said first actuator assembly comprises a first actuator subassembly having at least a part rotatable between a first position and a second position and is disposed in the an upper portion of the said latch assembly and said part of said first actuator assembly is disposed between said first actuator subassembly and said first or upper latch extension or element of said pivotal latch member such that said first actuator subassembly linearly and vertically moves said part of said first actuator assembly from said first position or configuration to said second position or configuration when said at least a part of said first actuator subassembly is rotated from said first position to said second position, such that said part of said first actuator assembly engages said first or upper latch extension or element' rotating said hook member upwardly and allowing the gate to be opened.

* * * * *